US007459620B1

(12) United States Patent
Kester

(10) Patent No.: US 7,459,620 B1
(45) Date of Patent: Dec. 2, 2008

(54) GUITAR PICK

(76) Inventor: James B. Kester, 5452 Santa Gertrudes, Garden Grove, CA (US) 92845

( * ) Notice: Subject to any disclaimer, the term of this patent is extended or adjusted under 35 U.S.C. 154(b) by 0 days.

(21) Appl. No.: 11/827,900

(22) Filed: Jul. 16, 2007

Related U.S. Application Data

(60) Provisional application No. 60/838,852, filed on Aug. 21, 2006.

(51) Int. Cl.
*G10D 3/16* (2006.01)

(52) U.S. Cl. ..... 84/320; 84/322

(58) Field of Classification Search ..... 84/320–322
See application file for complete search history.

(56) References Cited

U.S. PATENT DOCUMENTS 6,815,597 B1 * 11/2004 Bosley ..... 84/322
2005/0011336 A1 * 1/2005 Oskorep ..... 84/320

* cited by examiner

*Primary Examiner*—Kimberly R Lockett
(74) *Attorney, Agent, or Firm*—Allen A. Dicke, Jr.

(57) ABSTRACT

The guitar pick is formed of flexible sheet material and has a central opening therein, which is slotted open. The guitar pick is formed of flexible synthetic material and has a pick point for picking the guitar strings. The body of the guitar pick is sufficiently large to hold between the thumb and forefingers for its manipulation. The body has a central opening which is slotted away from the pick point. The central opening and the slot, together with the flexibility of the pick is sufficient to permit it to be snapped onto and off of pegs and posts on the guitar for storage and retrieval.

13 Claims, 2 Drawing Sheets

GUITAR PICK

CROSS-REFERENCE

This application relies for priority on my corresponding Provisional Application, Ser. No. 60/838,852, filed Aug. 21, 2006, the entire disclosure of which is incorporated herein by this reference.

BACKGROUND OF THE INVENTION

Guitars are stringed instruments which are usually played with a pick, which is a thin piece of material for deflecting and releasing the guitar strings. The pick is also called a "plectrum." The usual modern pick is of sheet polymer composition material which is fairly hard, but is still somewhat flexible. The material is thin, and the pick has a more pointed pick end used to deflect and release the guitar strings. The pick is sized to be held between the thumb and first finger with the pointed pick end extending beyond the fingers. Thus, it is a small device which may be easily mislaid.

SUMMARY OF THE INVENTION

In order to aid in the understanding of this invention, it can be stated in essentially summary form that it is directed to a guitar pick which is formed of a sheet of flexible material. The pick has a pointed pick end and, opposite the pointed pick end, the pick is slotted. The slot extends to a substantially central opening. The flexibility, slot and central opening are such that the pick can be snapped onto a guitar string adjustment peg or like structure so that it may be stored at that location when not in use.

It is, thus, a purpose and advantage of this invention to provide a guitar pick which has a built-in structure which permits it to be snapped into a storage location when not in use.

It is another purpose to provide an opening in the pick with a slot from the back of the pick to the opening to provide greater comfort and security in holding the pick between the thumb and forefinger.

It is another purpose and advantage of this invention to provide a guitar pick which is fully suitable for picking the guitar strings and yet has a convenient storage attachment structure associated therewith.

Other purposes and advantages of this invention will become apparent from a study of the following portion of the specification and the attached drawings.

DESCRIPTION OF THE PREFERRED EMBODIMENT

The guitar pick of this invention is generally indicated at 10 in FIGS. 1, 2, 3, 4 and 5. The pick is made of polymer sheet material of substantially uniform thickness. The thickness depends upon the flexibility, but in the usual guitar pick with some flexibility to the material, the thickness ranges from about 0.010 inch to 0.100 inch. The thickness is dependent on the flexibility of the material of the pick, the flexibility desired by the musician and the need for sufficient flexibility to be able to snap around a post, as is described below. Polyethylene, celluloid, polypropylene, nylon, polyurethane and similar synthetic polymer composition material are suitable. The guitar pick may be colored for convenience of identification, location or aesthetics.

Figure 1:
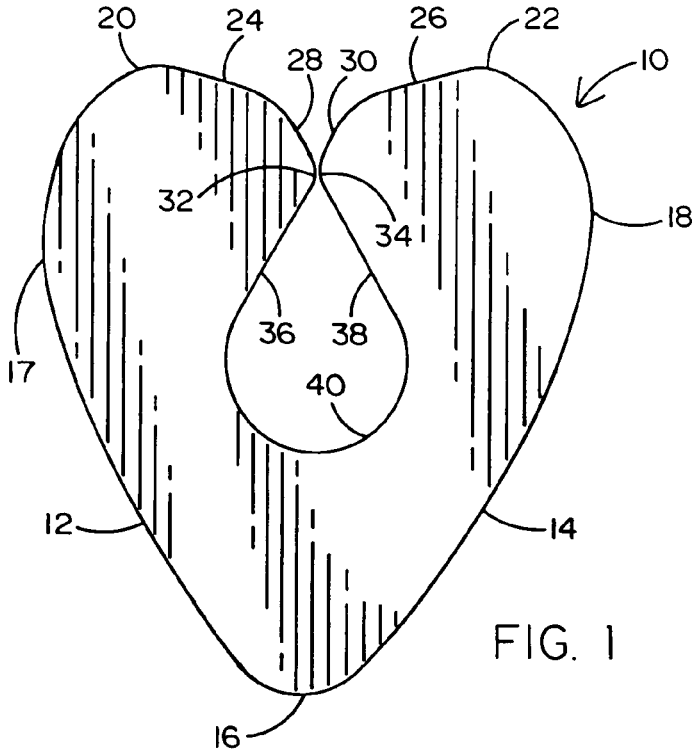
FIG. 1 is a plan view of the guitar pick of this invention, the back view being the same.
Figure 2:
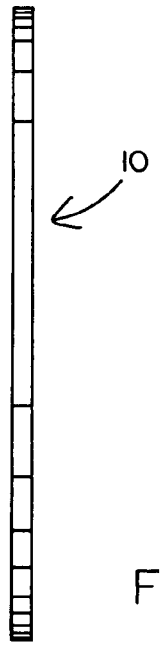
FIG. 2 is a right edge view thereof, the left edge view being the same.
Figure 3:
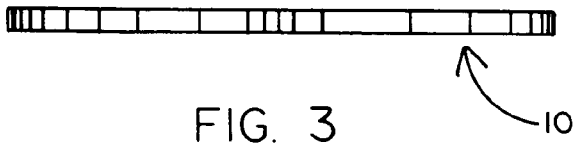
FIG. 3 is a top view thereof.
Figure 4:
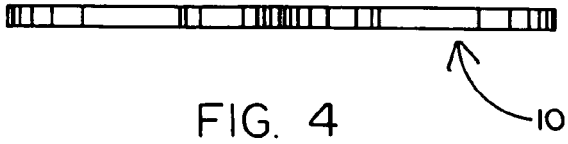
FIG. 4 is a bottom view thereof.

For convenience in holding the guitar pick between the thumb and forefinger, its width is preferably about 1½ inches wide and its height is about 1¾ inches high in the upward direction seen in FIG. 1. The guitar pick described below is a preferred configuration. The configuration can widely vary as long as it meets three requirements. It must serve as a proper guitar pick. It must be comfortable and secure to hold. It must be configured and sufficiently flexible to snap onto and off of a post.

The guitar pick 10 has left and right side edges 12 and 14 which are curved to a large radius of about 2¼ inches and which approach each other at about a 60 degree angle to rounded pick point 16, which has about a 7/16 inch radius. This is a preferred radius suitable for picking a guitar. The left and right shoulders 17 and 18 have about a 11/16 inch radius and transition into left and right top curves 20 and 22, which have about a 3/16 inch radius. The left and right top curves transition into left and right straight sections 24 and 26, which are substantially straight and which lie at substantially a 75 degree angle with respect to the vertical centerline through the pick 10, which is upright in FIG. 1.

Left and right entry surfaces 28 and 30 are short, straight sections which are at about 30 degrees from the upright centerline. They provide entry surfaces which can be used to wedge the guitar pick open, as described below. The entry surfaces join the straight sections by a small radius such as 3/16 inch. Pinch points 32 and 34 almost touch each other and are also preferably about 3/16 inch radius. Below the pinch points, the exit surfaces 36 and 38 join the pinch point radii 32 and 34 and join the wall 40 of the central opening. The wall 40 is preferably of about ¼ inch radius. It is thus seen that all of the curves are smooth and of comfortable size to hold in the fingers. The curves and straight edges are tangent to each other for aesthetic configuration.

The size of the central opening, defined by the wall 40, the surfaces 36 and 38, as well as the slot between the pinch points 32 and 34, coupled with the thickness and resiliency of the material of the pick 10, permits the pinch points to move from each other for access to the central opening.

Figure 5:
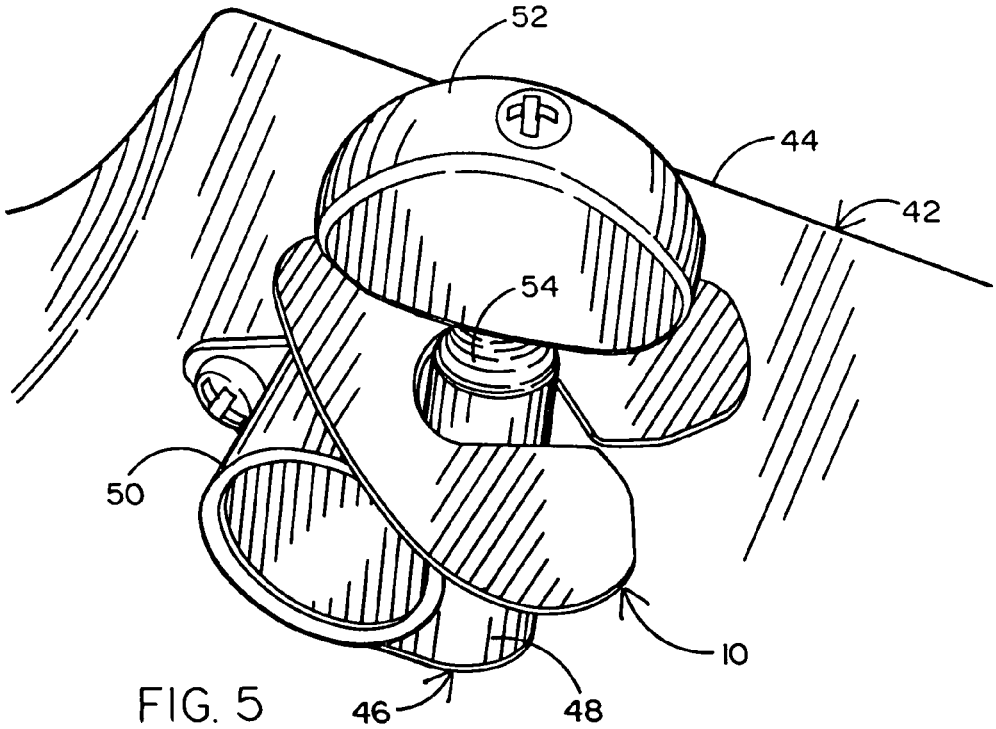
FIG. 5 is a perspective view showing the guitar pick in storage position snapped onto a tuning peg on a guitar.

FIG. 5 shows a guitar 42 having a neck 44. Only a portion of the outline of the neck is shown. Tuning peg 46 has a post 48 on which is mounted drum 50. One of the guitar strings is attached to the drum 50, and its tension is adjusted by rotation of the drum 50. Handle 52 is manually engageable to rotate worm 54, which engages in a worm wheel (not shown) attached to drum 50. Thus, rotation of the handle 52 rotates drum 50 to adjust the tension in the guitar string.

The post 48 is available for attachment of the guitar pick 10 thereto. The two wings of the guitar pick on opposite sides of the central division can be separated enough to permit the guitar pick 10 to be snapped around the post, as illustrated in FIG. 5. The guitar pick can be removed from the post in a similar manner. Thus, the guitar pick can be stored on the post when not in use and can be easily found and removed for use. The post 48 is described as a string tension adjusting structure. The pick 10 can be just as well snapped onto and off of any peg or strap post or any other post manufactured into any given guitar or onto a selector or toggle switch on an electric guitar.

Figure 6:
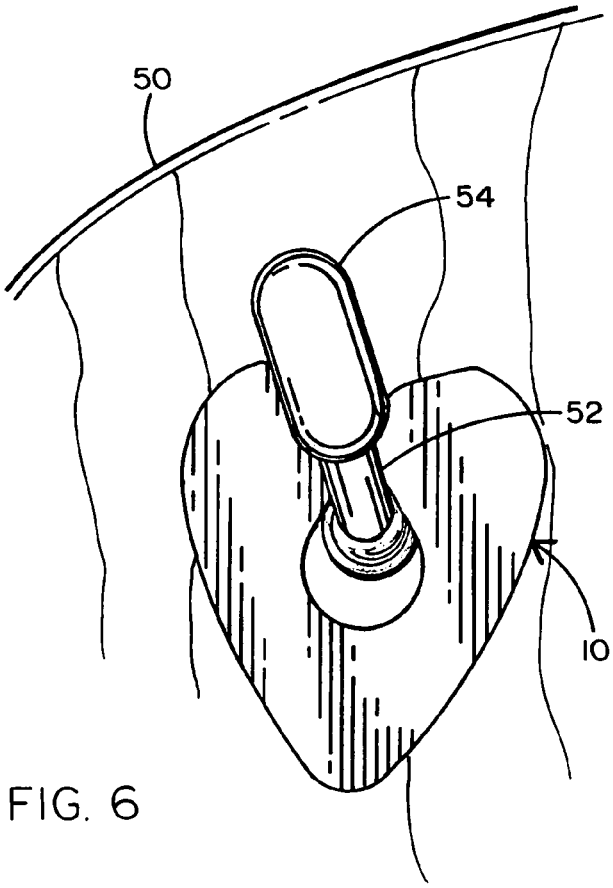
FIG. 6 is a perspective view showing the guitar pick in storage position snapped onto a selector switch on an electric guitar.

FIG. 6 shows an electric guitar 50 which has a control switch. The control switch includes a lever 52 which actuates the switch. The lever extends up from the guitar body and carries an actuating handle 54. The guitar pick 10 can be snapped onto and off of the switch lever for storage and later use.

The opening in the center of the pick 10 is essential to provide flexibility for the snap on and snap off function. It also permits the musician to firmly and comfortably grasp the pick. The pick is held more easily with the presence of the hole between the thumb and forefinger and the slot from the back of the pick to the hole.

While this disclosure describes in detail a guitar pick, it is clear that picks for mandolins and banjos are the same, and the pick described herein is also useable with those and other picked instruments.

This invention has been described in its presently preferred embodiment, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A guitar pick comprising:

a body, said body being formed of synthetic polymer composition material, said body having a pick point suitable for picking the strings of a guitar, said body being sized to be grasped between the fingers of a guitarist for picking the guitar strings;

an opening in said body, said opening in said body being positioned so that the guitarist's fingers grasping said guitar pick engage each other through said opening in said body to aid in retaining said pick in the guitarist's fingers, said opening having surfaces which define an entry path from the exterior of said pick to said interior opening in said body of said pick, said body being sufficiently flexible so that said body can be snapped onto and off of a projection from the guitar for storage and retrieval.

2. The guitar pick of claim 1 wherein said surfaces defining a pathway to entry into said opening include straight edges and curved edges.

3. A guitar pick comprising:

a body, said body being formed of synthetic polymer composition material which has a thickness from about 0.010 inch to 0.100 inch so that the guitar pick has sufficient flexibility as required by the guitarist and has sufficient flexibility to snap around a post, said body having a pick point suitable for picking the strings of a guitar, said body being sized to be grasped between the fingers of a guitarist for picking the guitar strings;

an opening in said body, said opening in said body being positioned so that the guitarist's fingers grasping said guitar pick engage each other through said opening in said body to aid in retaining said pick in the guitarist's fingers, said opening having surfaces which define an entry path from the exterior of said pick to said interior opening in said body of said pick, said body being sufficiently flexible so that said body can be snapped onto and off of a projection from the guitar for storage and retrieval.

4. A guitar pick comprising:

a body, said body being formed of synthetic polymer composition material, said body having a pick point suitable for picking the strings of a guitar, said body being sized to be grasped between the fingers of a guitarist for picking the guitar strings; said body of said guitar pick being about 1½ inches wide and about 1¾ inches high;

an opening in said body, said opening in said body being positioned so that the guitarist's fingers grasping said guitar pick engage each other through said opening in said body to aid in retaining said pick in the guitarist's fingers, said opening having surfaces which define an entry path from the exterior of said pick to said interior opening in said body of said pick, said body being sufficiently flexible so that said body can be snapped onto and off of a projection from the guitar for storage and retrieval.

5. The guitar pick of claim 4 wherein said central opening has exit surfaces which are positioned at an acute angle with respect to each other and which are close together at said slot.

6. The guitar pick of claim 1 wherein said surfaces which define an entry path leading to a pinch points from both within said opening in said guitar pick and from the exterior of said guitar pick.

7. The guitar pick of claim 6 wherein said surfaces leading from the exterior of said guitar pick to said pinch point surfaces are curved surfaces.

8. The guitar pick of claim 1 wherein said guitar pick has first and second edges which are curved to a large radius and define a rounded pick point, said exterior surfaces of said guitar pick extending from said large radius surfaces to converge together to said pinch points so that said exterior edge surfaces of said body join smoothly into each other.

9. The guitar pick of claim 8 wherein said surfaces defining said opening in said body includes circular surfaces and straight surfaces which join each other.

10. The guitar pick of claim 9 wherein said straight surfaces in said opening converge together and join said surfaces which define said pinch points.

11. The guitar pick of claim 1 wherein said opening in said body of said guitar pick is configured to engage on and be disengaged from a post on a guitar.

12. The guitar pick of claim 1 wherein said opening in said body of said guitar pick is configured to engage on and be disengaged from a peg on a guitar.

13. The guitar pick of claim 1 wherein said opening in said body of said guitar pick is configured to engage on and be disengaged from a switch on a guitar.

* * * * *